US008476512B1

(12) United States Patent
Corfe et al.

(10) Patent No.: US 8,476,512 B1
(45) Date of Patent: Jul. 2, 2013

(54) MUSICAL INSTRUMENT NECK

(76) Inventors: Christopher W Corfe, Haddenham (GB); Nicholas S Rolls, Haddenham (GB)

( * ) Notice: Subject to any disclaimer, the term of this patent is extended or adjusted under 35 U.S.C. 154(b) by 6 days.

(21) Appl. No.: 13/360,298

(22) Filed: Jan. 27, 2012

(51) Int. Cl.
*G10D 3/00* (2006.01)

(52) U.S. Cl.
USPC ..... 84/293

(58) Field of Classification Search
USPC ..... 84/267, 290, 293
See application file for complete search history.

(56) References Cited

U.S. PATENT DOCUMENTS 4,823,668 A * 4/1989 Marrs ..... 84/296
5,401,900 A * 3/1995 Lace ..... 84/743

* cited by examiner

*Primary Examiner* — Kimberly Lockett
(74) *Attorney, Agent, or Firm* — Richard S. Finkelstein

(57) ABSTRACT

According to some embodiments, a musical instrument comprises a neck, a pickup socket, and a bar coupled between the neck and the pickup socket.

13 Claims, 7 Drawing Sheets

MUSICAL INSTRUMENT NECK

BACKGROUND

Conventional stringed musical instruments, such as, but not limited to guitar, bass, banjo, and mandolin, comprise a body and a neck. The neck is coupled to the body at a neck joint. Some stringed musical instruments are electrified by including transducers (i.e., pickups) to convert string vibration to an electric signal. The shape or configuration of the body plays a significant role in shaping a tonal signature of the musical instrument. Some electrical musical instruments comprise hollow bodies and some comprise solid bodies.

For musical instruments with hollow bodies, the hollow body is a major determinant of the overall sound quality. The majority of the instrument's sound is heard through a top, or soundboard. The soundboard may define an opening to couple a pickup. However, because of the large open area within a hollow body, hollow body electric musical instruments are prone to feedback at higher volumes.

For musical instruments with a solid body, the solid body is typically carved or routed to receive the neck in a neck cavity. The neck is either glued into the neck cavity or bolted from an underside of the cavity such that bolts secure the neck to the body where the bolts are disposed perpendicular to a longitudinal direction (e.g., axis) of the neck. The solid body further includes other separate carved or routed cavities to accept a bridge, pickup, or other electronic components. Using routed or carved cavities in a solid body provides for a musical instrument that is resistant to feedback.

DETAILED DESCRIPTION

Figure 1:
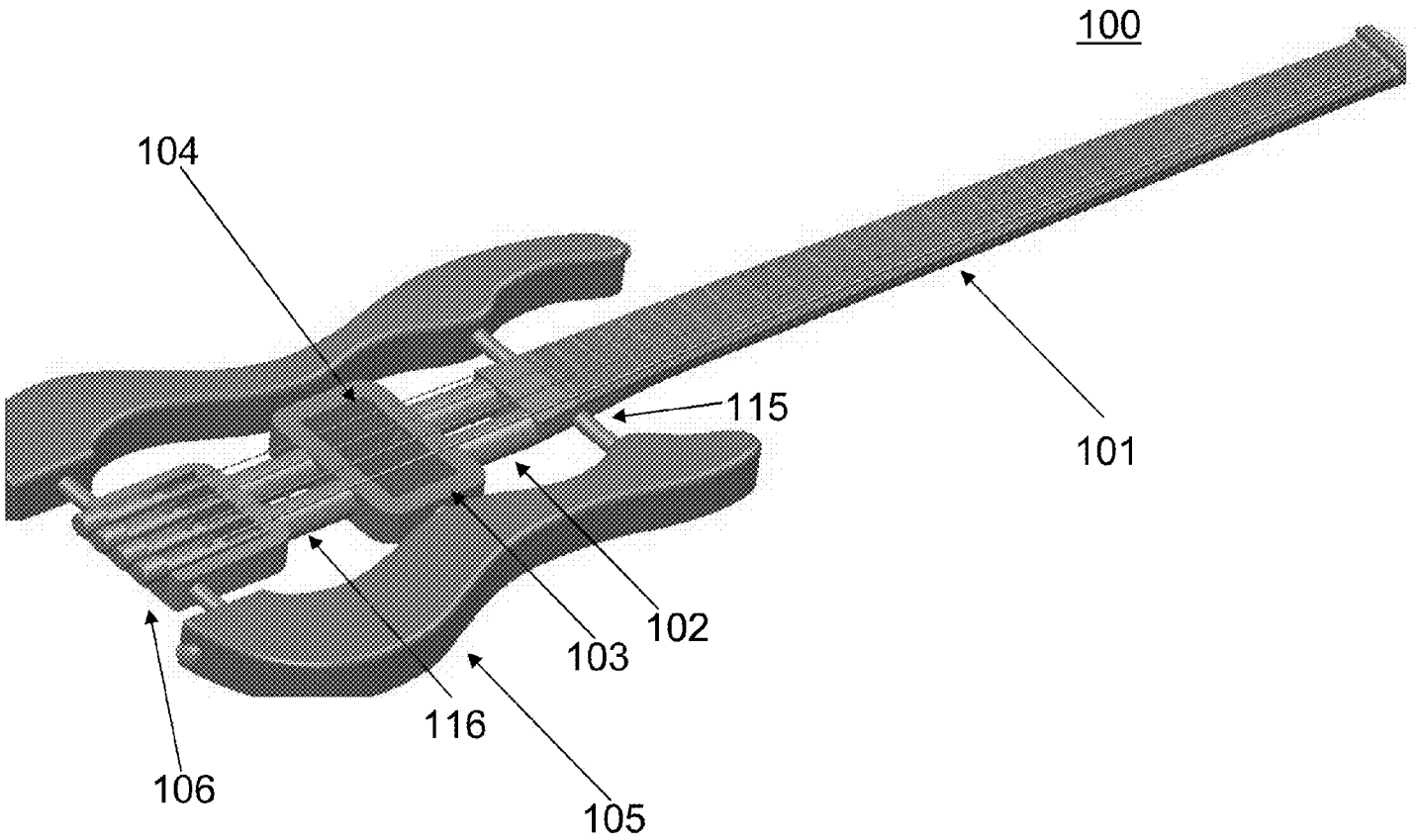
FIG. 1 is a perspective view of a musical instrument according to some embodiments.

Referring now to FIG. 1, an embodiment of a musical instrument 100 is illustrated. The musical instrument 100 comprises a neck 101, one or more bars 102, a pickup socket 103, a pickup 104, body portions 105, a bridge 106, side supports 115, and one or more second bars 116.

The neck 101 may be comprised of wood, aluminum, a carbon fiber composite material, Plexiglas, or any known material capable of being formed into a rigid structure. The neck 101 may be coupled to the pickup socket 103 via the one or more bars 102. As illustrated, the one or more bars 102 comprise cylindrical shaped bars. However, the one or more bars 102 may comprise a cuboid, a rectangular prism, or any other shape. In some embodiments, the neck 101 and the one or more bars 102 may be machined/milled/cast out of a single material or a single piece of material.

As illustrated, the pickup socket 103 comprises a pickup 104 for receiving vibrations from one or more strings. The pickup socket 103 may be sized to receive the pickup 104 with less than a ¼ inch of a gap between an edge of the pickup 104 and a wall of the pickup socket 103.

The one or more second bars 116 are coupled between the pickup socket 103 and the bridge 106 to create a substantially rigid center structure in conjunction with the one or more first bars 102. The body portions 105 are coupled to the substantially rigid center structure via the side supports 115 which are coupled to the neck 101 and the bridge 106. Creating a substantially rigid center structure by coupling the neck 101 to the one or more bars 102, the one or more bars 102 to the pickup socket 103, the pickup socket 103 to the second bars 116, and the second bars 116 to the bridge 106 provides for a musical instrument with enhanced sustained sound that is resistant to feedback. Furthermore, such a structure may be lighter than conventional solid body musical instruments. Moreover, such a structure may be thinner than conventional stringed musical instruments which may bring a center of gravity of the stringed musical instrument towards the player. A closer center of gravity may improve a balance of the instrument so that the stringed musical instrument is neither neck-heavy nor body-heavy.

Figure 2:
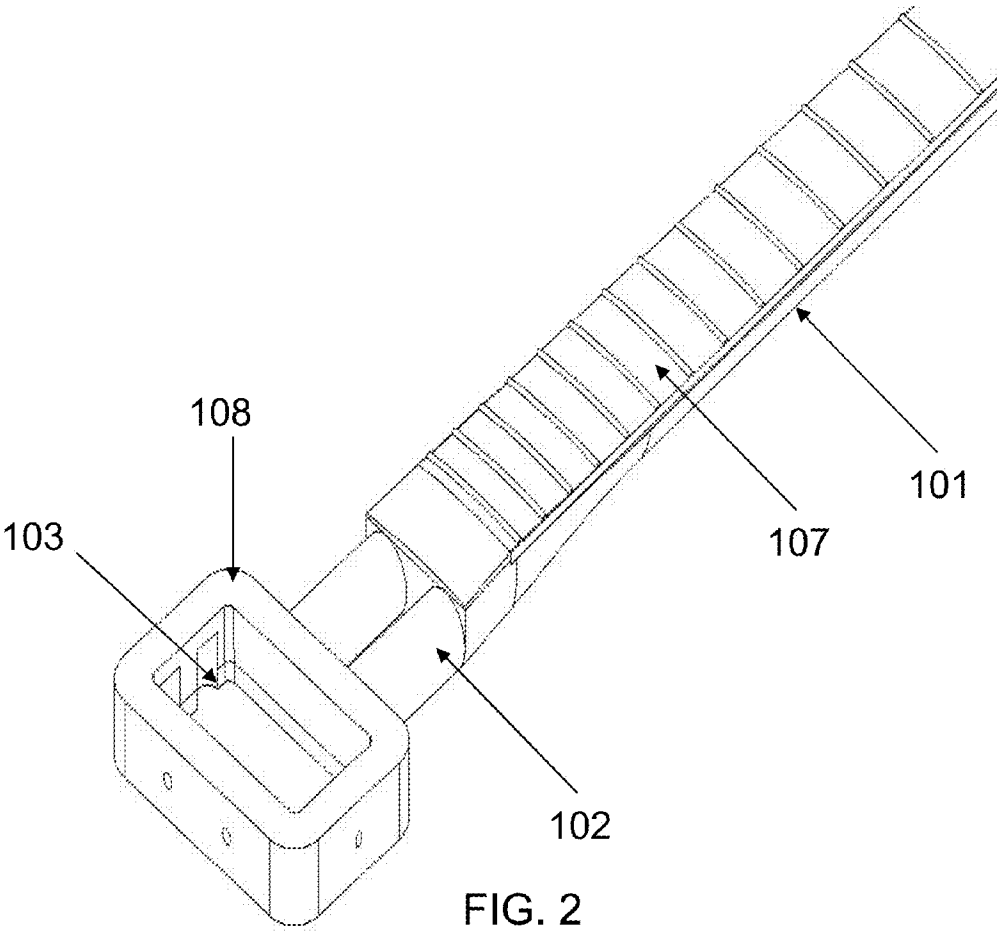
FIG. 2 is a perspective view of a musical instrument neck coupled to a pickup socket according to some embodiments.
Figure 3:
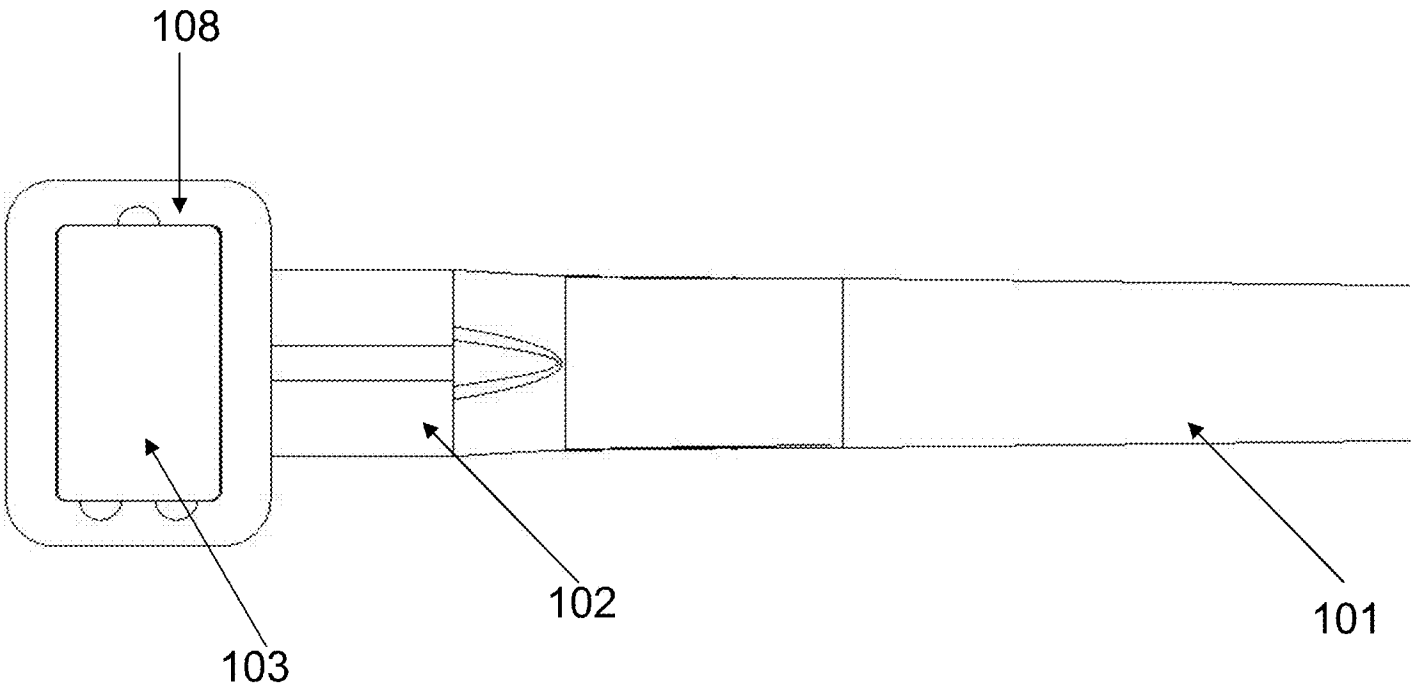
FIG. 3 illustrates a bottom view of a musical instrument neck coupled to a pickup socket according to some embodiments.
Figure 4:
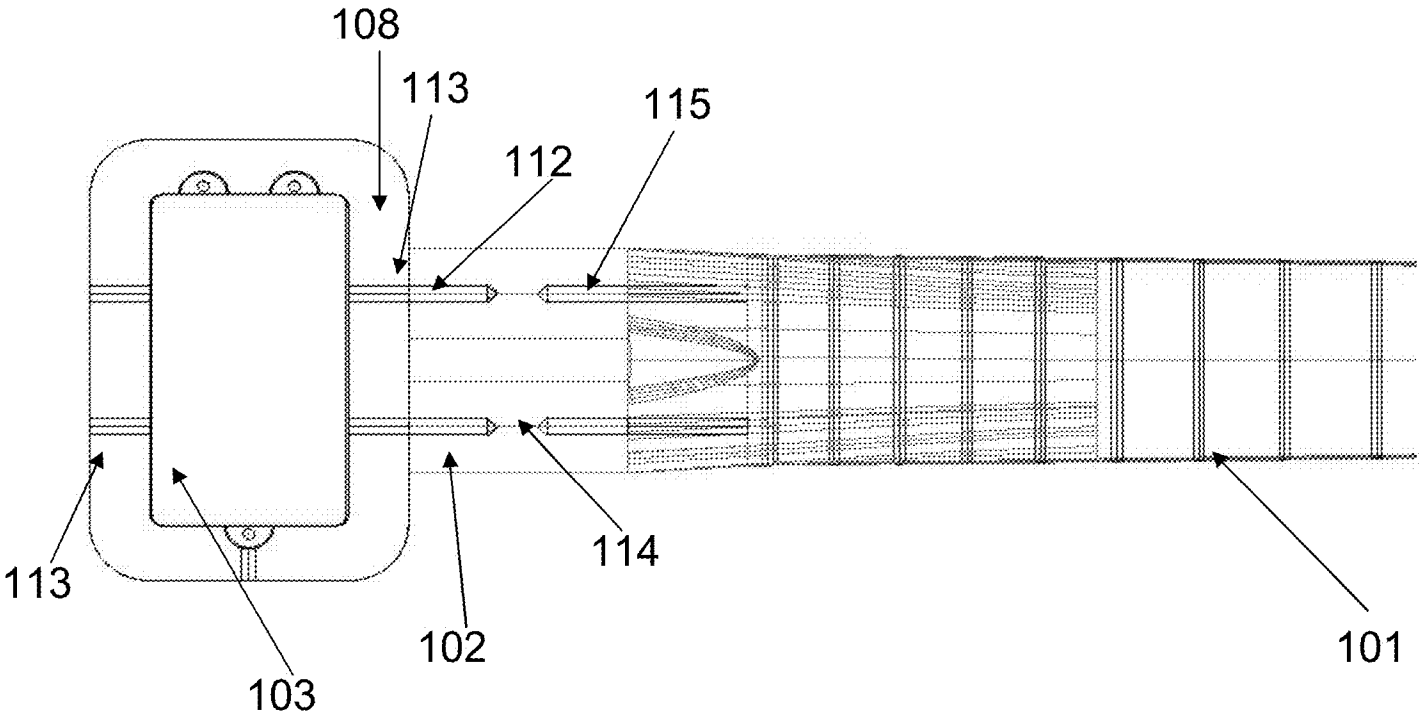
FIG. 4 illustrates a front view of a musical instrument neck coupled to a pickup socket according to some embodiments.

Now referring to FIGS. 2, 3, and 4, an embodiment of a neck 101 coupled to a pickup socket 103 is illustrated. As illustrated, the neck 101 comprises a fingerboard 107 which may comprise frets (i.e., fretboard) or may comprise a fretless fingerboard. The fingerboard 107 may be disposed between a distal end of the neck 101 and the one or more bars 102. The fingerboard 107 may comprise a strip of material, such as, but not limited to wood, that is coupled to a top portion of the neck 101. In some embodiments, the fingerboard 107 may comprise a separate material than the neck 101. However, in other embodiments a top surface of the neck 101 may be configured as a fingerboard 107 without the addition of a separate strip of material and, in this case, the neck 101 and the fingerboard 107 may comprise a same material. For example, the neck 101 and the fingerboard 107 may be machined/milled/cast out of one piece of material. The fingerboard 107 may not extend past an end of the neck 101 that is coupled to the one or more bars 102 thereby preventing the fingerboard 107 from bending should the substantially rigid center structure be flexed.

The pickup socket 103 may comprise a cavity portion and a wall portion 108. Furthermore, the pickup socket 103 may define a plurality of slots and/or openings to couple the pickup 104 and/or to couple the one or more bars 102 to the wall portion 108 of the pickup socket 103.

As illustrated in FIG. 4, the wall portion 108 defines a plurality of openings 113 to allow coupling of the pickup socket 103 to the one or more bars 102. In the present embodiment, a fastener 112, such as, but not limited to, a bolt, screw, or other fastener, may extend from the pickup cavity 103 through the wall portion 108 and into a bar channel 114 where the fastener 112 is secured to the one or more bars 102. Likewise, a second fastener 115 may extend from the neck 101 and into a bar channel 114 where the second fastener 115 is secured to the one or more bars 102. The fastener 112 and the second fastener 115 may comprise different types of fasteners or may comprise a same type of fastener.

In some embodiments, the fastener 112 may comprise a first end and a second end where the first end is coupled to the neck 101 and the second end is coupled to the pickup socket 103. In this embodiment, the fastener 112 may extend through the bar channel 114. The bar channel 114 may be coplanar with the neck 101. In some embodiments, the bar channel 114 may be threaded to receive the fastener 112.

Figure 5:
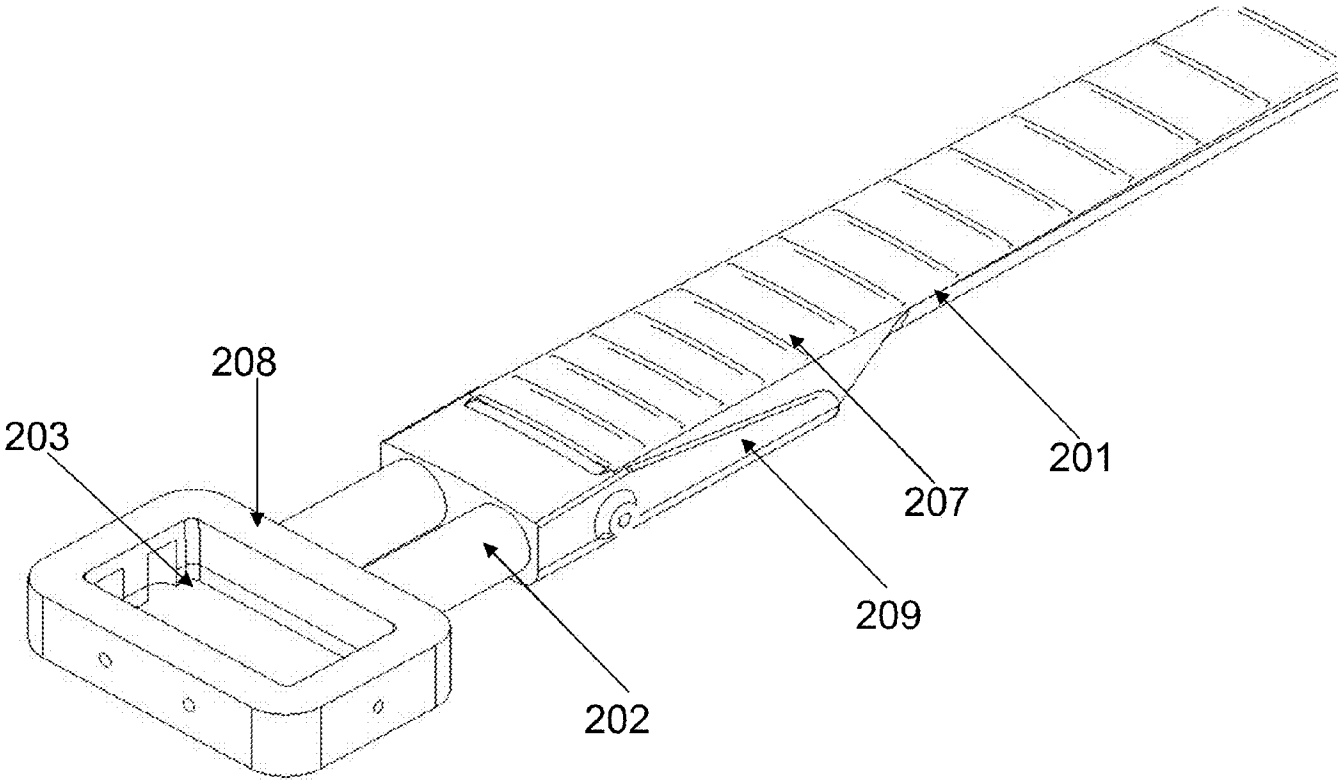
FIG. 5 is a perspective view of a musical instrument neck coupled to a pickup socket according to some embodiments.
Figure 6:
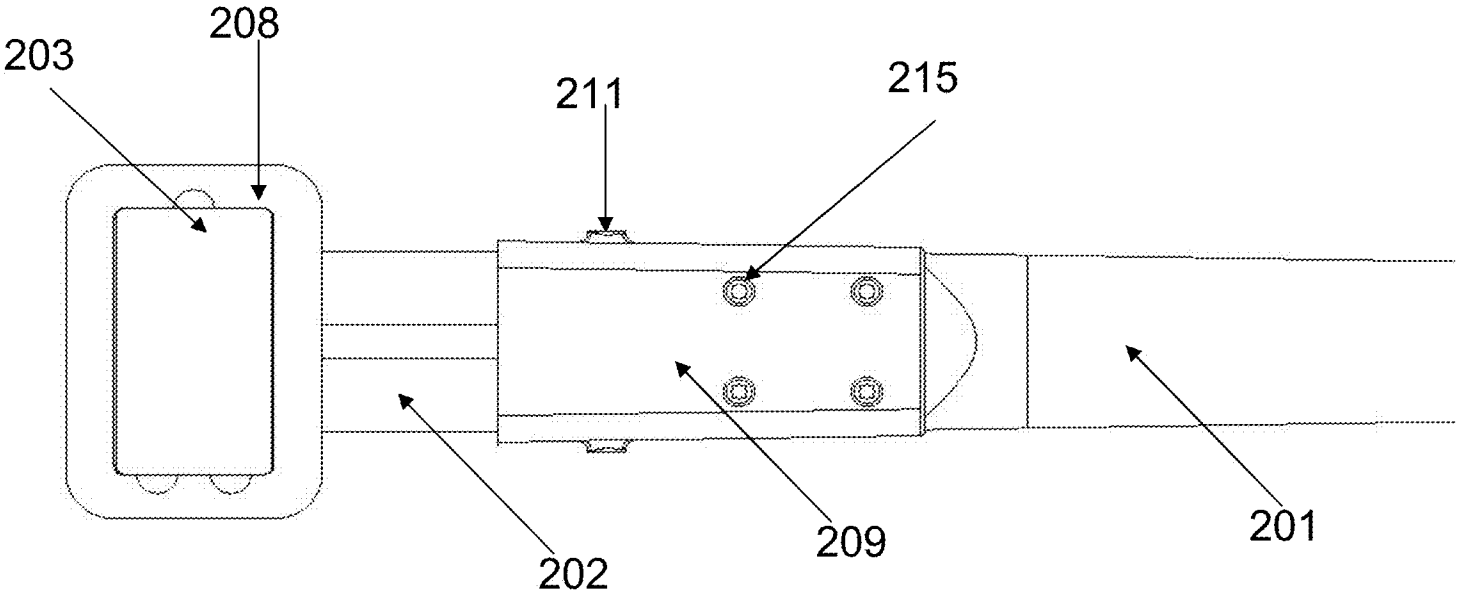
FIG. 6 illustrates a bottom view of a musical instrument neck coupled to a pickup socket according to some embodiments.
Figure 7:
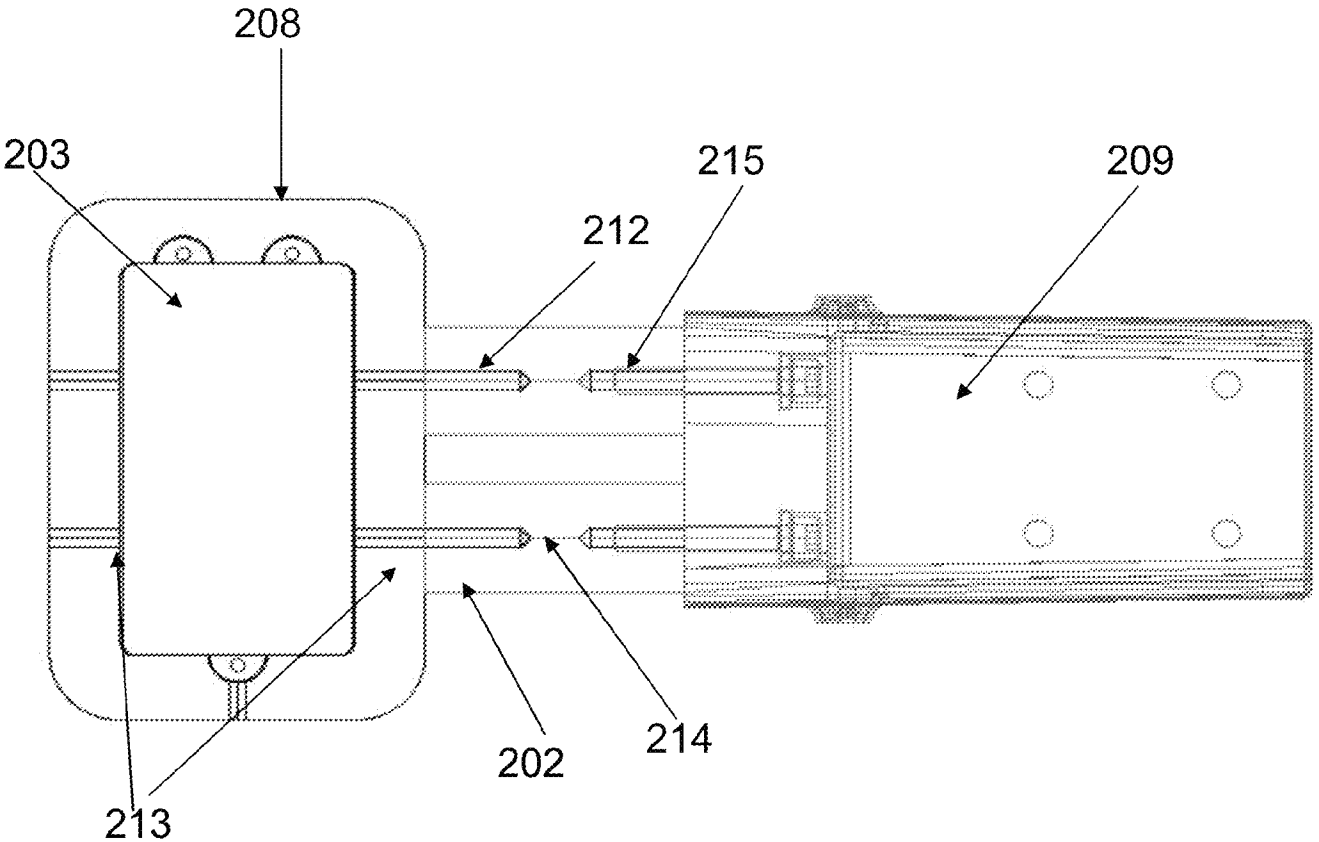
FIG. 7 illustrates a front view of a musical instrument neck coupled to a pickup socket according to some embodiments.

Now referring to FIGS. 5, 6, and 7 an embodiment of a neck 201 coupled to a pickup socket 203 is illustrated. In some embodiments, FIGS. 5, 6, and 7 illustrates the use of a shoe 209 to facilitate coupling of the neck 201 to the pickup socket 203. In some embodiments, the shoe 209 may be an extension of the neck 201. The shoe 209 may provide a neck socket to receive the neck 201 and to couple the neck 201 to the shoe 209 via a plurality of fasteners 215 disposed perpendicular to a longitudinal axis of the neck. The shoe 209 may further comprise access points 211 to couple the side supports 115. The shoe 209 and the one or more bars 202 may be machined/milled/cast out of one piece of material. According to some embodiments, the use of a shoe 209 may allow for easier replacement of a neck 201.

As illustrated in FIG. 7, a wall portion 208 defines a plurality of openings 213 to facilitate coupling of the pickup socket 203 to the one or more bars 202. In the present embodiment, a fastener 212, such as, but not limited to, a bolt, screw, or other fastener, may extend from the pickup socket 203 through the wall portion 208 and into a bar channel 214 where the fastener is secured to the one or more bars 202. Likewise, a second fastener 215 may extend from the shoe 209 and into the bar channel 214 where the second fastener 215 is secured to the one or more bars 202. The fastener 212 and the second fastener 215 may comprise different types of fasteners or may comprise a same type of fastener.

In some embodiments, a portion of the fastener 212 may be countersunk in the wall portion 208. In other embodiments, the fastener 212 may comprise a first end and a second end where the first end is coupled to the shoe 209 and the second end coupled to the pickup socket 203.

Various modifications and changes may be made to the foregoing embodiments without departing from the broader spirit and scope set forth in the appended claims.

What is claimed is:

1. A musical instrument comprising:

a neck;

a pickup socket;

a bar coupled between the neck and the pickup socket; and a first fastener comprising a first end and a second end, the first end coupled to the neck and the second end coupled to the pickup socket, wherein the bar defines a channel and the first fastener is disposed in the channel.

2. The musical instrument of claim 1, wherein the neck comprises a fingerboard that is disposed between a distal end of the neck and the bar.

3. The musical instrument of claim 1, wherein the bar is coupled to the neck via a shoe.

4. The musical instrument of claim 3, wherein the neck is coupled to the shoe via a plurality of fasteners disposed perpendicular to a longitudinal axis of the neck.

5. A musical instrument comprising:

a neck;

a pickup socket;

a bar coupled between the neck and the pickup socket, the bar defining a channel between the neck and the pickup socket;

a first fastener comprising a first end and a second end, the first end coupled to the bar and the second end coupled to the pickup socket; and a second fastener comprising a third end and a fourth end, the third end coupled to the bar and the fourth end coupled to the neck.

6. The musical instrument of claim 5, wherein the neck comprises a fingerboard that is disposed between a distal end of the neck and the bar.

7. The musical instrument of claim 6, wherein the bar is coupled to the neck via a shoe.

8. The musical instrument of claim 7, wherein the neck is coupled to the shoe via a plurality of fasteners disposed perpendicular to a longitudinal axis of the neck.

9. A musical instrument comprising:

a neck;

a pickup socket;

a bar coupled between the neck and the pickup socket; and a first fastener comprising a first end and a second end, the first end coupled to the bar and the second end coupled to the pickup socket; and a second fastener comprising a third end and a fourth end, the third end coupled to the bar and the fourth end coupled to the neck.

10. The musical instrument of claim 9, wherein the bar defines a channel and the first fastener is disposed in the channel.

11. The musical instrument of claim 9, wherein the neck comprises a fingerboard that is disposed between a distal end of the neck and the bar.

12. The musical instrument of claim 9, wherein the bar is coupled to the neck via a shoe.

13. The musical instrument of claim 12, wherein the neck is coupled to the shoe via a plurality of fasteners disposed perpendicular to a longitudinal axis of the neck.

* * * * *